US012539444B2

(12) United States Patent
Camrud

(10) Patent No.: US 12,539,444 B2
(45) Date of Patent: Feb. 3, 2026

(54) ARM EXERCISE DEVICE UTILIZING A NEUTRAL WRIST POSITION

(71) Applicant: Cubed Therapy LLC, Detroit Lakes, MN (US)

(72) Inventor: Connor Camrud, Detroit Lakes, MN (US)

(73) Assignee: CUBED THERAPY LLC, Detroit Lakes, MN (US)

( * ) Notice: Subject to any disclaimer, the term of this patent is extended or adjusted under 35 U.S.C. 154(b) by 92 days.

(21) Appl. No.: 18/310,009

(22) Filed: May 1, 2023

(65) Prior Publication Data

US 2023/0356027 A1 Nov. 9, 2023

Related U.S. Application Data

(60) Provisional application No. 63/339,128, filed on May 6, 2022.

(51) Int. Cl.

| | |
|---|---|
| ***A63B 23/035*** | (2006.01) |
| ***A63B 21/00*** | (2006.01) |
| ***A63B 23/12*** | (2006.01) |

(52) U.S. Cl.

CPC .... *A63B 23/03516* (2013.01); *A63B 21/0004* (2013.01); *A63B 21/00185* (2013.01); *A63B 21/4035* (2015.10); *A63B 21/4049* (2015.10); *A63B 23/12* (2013.01); *A63B 2225/09* (2013.01)

(58) Field of Classification Search

CPC ..... A63B 23/03516; A63B 21/0004; A63B 21/00185; A63B 21/4035; A63B 21/4049; A63B 2225/09; A63B 21/0125; A63B 22/0005; A63B 22/0605–0694; A63B 23/12–16; A63B 23/1245–14

See application file for complete search history.

(56) References Cited

U.S. PATENT DOCUMENTS

| | | | | |
|---|---|---|---|---|
| 2,388,777 A | | 11/1945 | Wentz | |
| 3,062,543 A | * | 11/1962 | Shaboo | A63B 22/0005 482/125 |
| 3,396,967 A | * | 8/1968 | Brown | A63B 23/14 482/46 |
| 3,713,653 A | | 1/1973 | Romans | |
| D250,782 S | | 1/1979 | Gibson | |
| D253,903 S | | 1/1980 | Gibson | |
| 4,225,130 A | | 9/1980 | Zimmerman | |

(Continued)

FOREIGN PATENT DOCUMENTS

| | | |
|---|---|---|
| GB | 2464100 A | 4/2010 |
| JP | 6814502 B1 | 1/2021 |

(Continued)

*Primary Examiner* — Nyca T Nguyen

(74) *Attorney, Agent, or Firm* — GRUMBLES LAW PLLC; Bryan Kravis

(57) ABSTRACT

An improved exercise device to allow a user a natural hand position to focus the exercise on a particular muscle group or secondary task within the user's upper extremity by providing handgrips wherein a user may position their wrist in a variety of manners most functional to the individual or exercise. The device can assist users in their therapy to rehabilitate their muscles. The device and method provide a user with neutral wrist positioning while exercising by rotating the device in a circular manner about a single axis.

18 Claims, 5 Drawing Sheets

(56) References Cited

U.S. PATENT DOCUMENTS

| | | | | |
|---|---|---|---|---|
| D268,046 | S | 2/1983 | Bell | |
| 4,664,370 | A | 5/1987 | Finch | |
| 4,838,542 | A * | 6/1989 | Wilkinson | A63B 21/075 482/45 |
| 4,869,491 | A | 9/1989 | Nolan | |
| 4,901,999 | A | 2/1990 | Schott | |
| 5,046,727 | A * | 9/1991 | Wilkinson | A63B 21/015 428/909 |
| 5,244,442 | A | 9/1993 | Schill | |
| 5,490,817 | A * | 2/1996 | Stander | A63B 23/14 482/45 |
| D397,174 | S | 8/1998 | Sandoval | |
| 6,048,293 | A * | 4/2000 | Lee | A63B 21/4035 482/57 |
| 6,071,214 | A | 6/2000 | Osterman | |
| 6,129,650 | A * | 10/2000 | Wedge, Jr. | A63B 21/0004 482/44 |
| 6,217,494 | B1 | 4/2001 | Sandoval | |
| 7,175,572 | B2 | 2/2007 | Stonecipher | |
| 7,614,984 | B1 * | 11/2009 | Krull | A63B 23/03533 482/131 |
| 8,075,453 | B1 * | 12/2011 | Wilkinson | A63B 21/4019 482/8 |
| 8,915,828 | B1 * | 12/2014 | Stalnaker | A63B 23/1209 482/131 |
| 9,433,815 | B1 * | 9/2016 | Hughes | A63B 15/00 |
| 9,492,706 | B1 * | 11/2016 | Turnbow | A63B 22/0605 |
| 9,566,469 | B1 | 2/2017 | Rector | |
| 2003/0092536 | A1 | 5/2003 | Romanelli et al. | |
| 2003/0096680 | A1 * | 5/2003 | Nethery | A63B 23/03516 482/92 |
| 2005/0239614 | A1 | 10/2005 | Herder | |
| 2012/0196729 | A1 * | 8/2012 | Rafaeli | A63B 21/065 482/110 |
| 2015/0258368 | A1 | 9/2015 | Turnbow et al. | |
| 2018/0200574 | A1 * | 7/2018 | Connolly | A63B 21/028 |
| 2020/0261765 | A1 * | 8/2020 | Jones | A63B 22/0005 |
| 2022/0273980 | A1 * | 9/2022 | Kinney | A63B 21/4035 |

FOREIGN PATENT DOCUMENTS

| | | | |
|---|---|---|---|
| RU | 2671343 | C1 | 10/2018 |
| WO | 2020208795 | A1 | 10/2020 |

* cited by examiner

ARM EXERCISE DEVICE UTILIZING A NEUTRAL WRIST POSITION

FIELD

This disclosure relates to exercise devices, particularly to such exercise devices that provide arm exercise that may include dual hand grips for providing a range of hand placements for a user to focus their exercise on particular muscle groups within their arm while allowing a user to position their hands to give a natural wrist position.

BACKGROUND

During physical therapy, particularly physical therapy for persons recovering from injuries to their arms, devices are needed to assist such persons in increasing their strength and mobility of the injured structure. Such devices can provide exercise for specified muscle groups of an end-user by generating rotational torque.

Current exists that discloses devices that can provide rotational torque; however, such devices include handgrips, which can leave an end-user with only one possible grip position. Without the ability to position an end user's hands properly, that end user may not be able to perform the required exercise with their wrist in an undesirable orientation.

Throughout the course of clinical shoulder and upper body therapy, exercise, and rehabilitation, as well as in situations outside the clinical setting, a person or professional may be in need of exercise devices to allow the glenohumeral joints to freely rotate while controlling the degree of stressors placed upon the dynamic and inert stabilizers of the shoulders, elbows, and wrists in order to allow for the strengthening and mobility progressions, recovery, or maintenance of the aforementioned anatomical regions. One class of devices is commonly referred to as "upper body ergometers." Improvements in this class of devices are continually sought out.

Current devices within the upper body ergometer classification may provide rotational torque but lack the proper wrist positioning to ensure ideal ergonomic positioning and proper rotational function as they require an end-range, over-pronated positioning of the wrist to be utilized, thus placing the user at increased risk for other upper extremity complications as the physiologic adjustments due to this over-pronated positioning must be compensated through further adjustments at the elbow and shoulder regions. Other upper-body ergometers exist that may be able to provide a stabilizer which incorporates bases and attached seats or an attached stand requiring a platform to be used. These devices further suffer from their own independent and respective shortcomings, such as cost, associated space footprint, portability, base stability, required platform status, and/or over-pronated positioning.

SUMMARY

According to this disclosure, an exercise device can provide a handheld rotational exercise device that can create rotational torque. Such devices can deliver exercise of a specified muscle group for an end user. More specifically, an embodiment of an exercise device can comprise an adjustable length frame that includes a frame axis, with a first end, and a second end, wherein the first end and the second end can be positioned at opposite oblique angles with respect to the frame axis. This embodiment may also include a length adjuster, a first bearing that can be disposed within the first end; a second bearing that can be disposed within the second end; a first ergonomic handgrip that can be disposed on the first bearing; a first tensioner, wherein the first tensioner may be disposed on the first end and can be structured and configured to adjust a torque of the first bearing; a second ergonomic handgrip that can be disposed on the second bearing; and a second tensioner, wherein the second tensioner can be disposed on the second end and can be structured and configured to adjust a torque of the second bearing.

In some embodiments of such an arm exercise device, there can be a set of iteratively spaced cavities disposed within the length adjustable frame. In such embodiments, the iteratively spaced cavities may work in conjunction with a peg disposed within the length adjustable frame, wherein the peg can be structured and configured to fit within the set of iteratively spaced cavities, and wherein the length adjuster may be able to disengage and engage the peg from the set of iteratively spaced cavities. Further refinements of such an embodiment, may also include a length adjuster that can be structured and configured to provide an adjustable length of the axis in a range of twelve to seventeen inches.

In another embodiment, of an exercise device wherein the first ergonomic handgrip can further comprise a first axle having a first axle axis, wherein the first axle can be disposed on the first bearing; and the second ergonomic handgrip can further comprise a second axle having a second axle axis, wherein the second axle can be disposed on the second bearing. In such embodiments, further refinements can include the first axle axis and the second axle axis acting as terminal sides of the opposite oblique angles, wherein the frame axis may be the initial side An additional embodiment of an exercise device may include a first tensioner that may work with a tension pad; and a second tensioner that may work with a tension pad. Or an embodiment where the opposite oblique angles can be about 100 degrees to about 120 degrees with respect to the frame axis.

Another embodiment may include the first ergonomic handgrip and the second ergonomic handgrip that can be structured and configured to provide a user with multiple gripping positions. In such an embodiment, a further refinement may be to include at least one of the multiple gripping positions being able to provide a neutral wrist position.

A method for using an exercise device may include providing an arm exercise device that can have a length adjustable frame having a frame axis, a first end, and a second end, wherein the first end and the second end can be positioned at opposite oblique angles with respect to the frame axis; a length adjuster; a first bearing that can be disposed within the first end; a second bearing that can be disposed within the second end; a first ergonomic handgrip that may be disposed on the first bearing; a first tensioner, wherein the first tensioner can be disposed on the first end and can be structured and configured to adjust the torque of the first bearing; a second ergonomic handgrip that may be disposed on the second bearing; and a second tensioner, wherein the second tensioner can be disposed on the second end and can be structured and configured to adjust the torque of the second bearing. Where the next step in the method can be determining a first grip position for an end user to grip the first ergonomic handgrip with the first hand, followed by determining a second grip position for the end user to grip the second ergonomic handgrip with a second hand; then setting a first tension for the first tensioner; followed by setting a second tension for the second tensioner; then instructing the end-user to place their first hand in the first grip position; then instructing the end-user to place their second hand in the second grip position; and then instructing the end-user to rotate the arm exercise device.

An additional embodiment of such a method may include the first ergonomic handgrip that may further comprise a first axle that can have a first axle axis, wherein the first axle can be disposed on the first bearing; and the second ergonomic handgrip may further comprise a second axle that can have a second axle axis, wherein the second axle can be disposed on the second bearing. In such an embodiment, there may also be the first axle axis and the second axle axis that may act as terminal sides of the opposite oblique angles, wherein the frame axis may be the initial side. A potential refinement of that method may include the opposite oblique angles that can be about 100 degrees to about 120 degrees.

A variation of a previously described method may include the first ergonomic handgrip and the second ergonomic handgrip that can be structured and configured to provide the end-user with multiple gripping positions. In such embodiments, there may also be the first grip position and the second grip position that may provide a neutral wrist position.

A further variation of a previously described method may include the length adjuster that can be structured and configured to provide an adjustable length of the axis in a range of twelve to seventeen inches. In such embodiments, there may also be the further steps of determining a therapeutic length for the end-user, and then potentially setting the adjustable length of the frame axis to the therapeutic length.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention, and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings.

DETAILED DESCRIPTION

Figure 1:
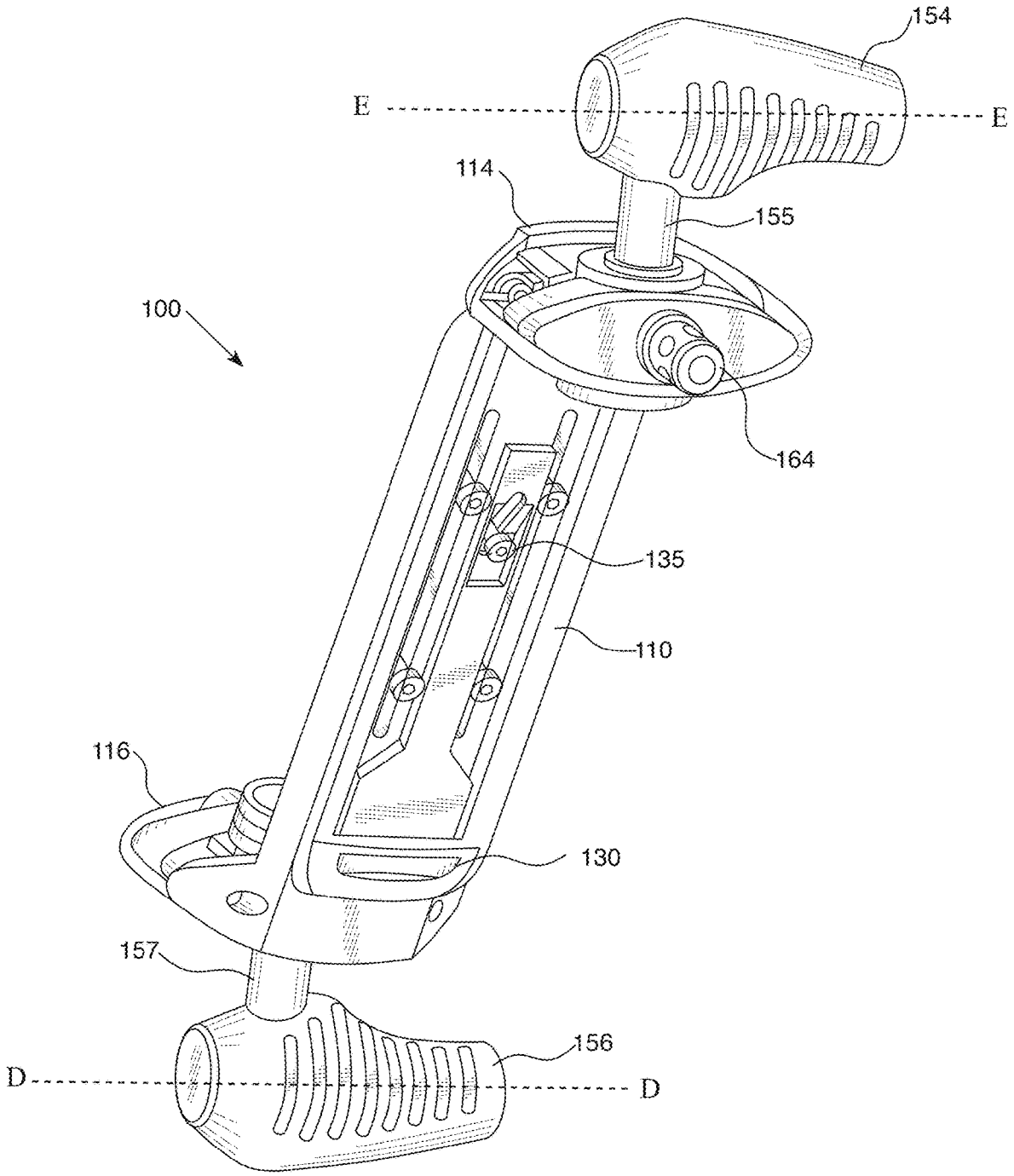
FIG. 1 is a front isometric view of an embodiment of the exercise device.

The present disclosure relates to exercise devices, particularly to such exercise devices that may provide exercise for a user's arms which can provide a wide range of motion. Various embodiments are described in detail with reference to the drawings, in which reference numerals may be used to represent parts and assemblies throughout the several views. Reference to various embodiments does not limit the scope of the systems and methods disclosed herein. Examples of construction, dimensions, and materials may be illustrated for the various elements; those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient. Still, these are intended to cover applications or embodiments without departing from the disclosure's spirit or scope. Also, it is to be understood that the phraseology and terminology used herein are for the purpose of description and should not be regarded as limiting.

The current concept is a new and useful design for an exercise device that falls into the class of ergometers. These ergometers can provide a bilateral rotational motion with varying tensions, and a method of use for such a device where an end-user can exercise their upper extremities. Other uses may include, but not be limited to, using the device as a secondary mechanism to further stress and develop an individual's dual-task, coordination, postural, abdominal exercise, and balance abilities. The device is slender, lightweight, and portable, thus making it an efficient device for transport and storage within a carrying bag, clinical setting, or home setting. The device may be fabricated from plastic, metal, and composite components.

Whereas, for these ergometers, the degree of stress placed upon the upper extremity musculature and inert structures can be controlled by a rotational device, which may be succinctly explained as being similar to rotating bike pedals, which can vary the degree of torque resistance throughout the motion. The new device improves upon the current class of upper body ergometers to allow for this controlled degree of stress while improving the ergonomic comfort, physiologic function and positioning, and portability aspects while preserving the key features of the rotational torque that are essential to upper body ergometer progressive function.

The new device utilizes a novel form of handheld portability and resistance while ensuring the neutral wrist positioning and functional improvements are maintained to reduce the previously alluded to detrimental postural and positional compensations. A Neutral wrist position would be approximately 20-30 degrees of wrist extension, with 0-10 degrees of ulnar deviation, and −5 to +5 degrees of pronation/supination, depending on a person's anatomical alignment. The ulnar deviation can be a component of the positioning offered by the handgrips; it may be achieved by proper handhold and usage positioning instruction.

Figure 2:
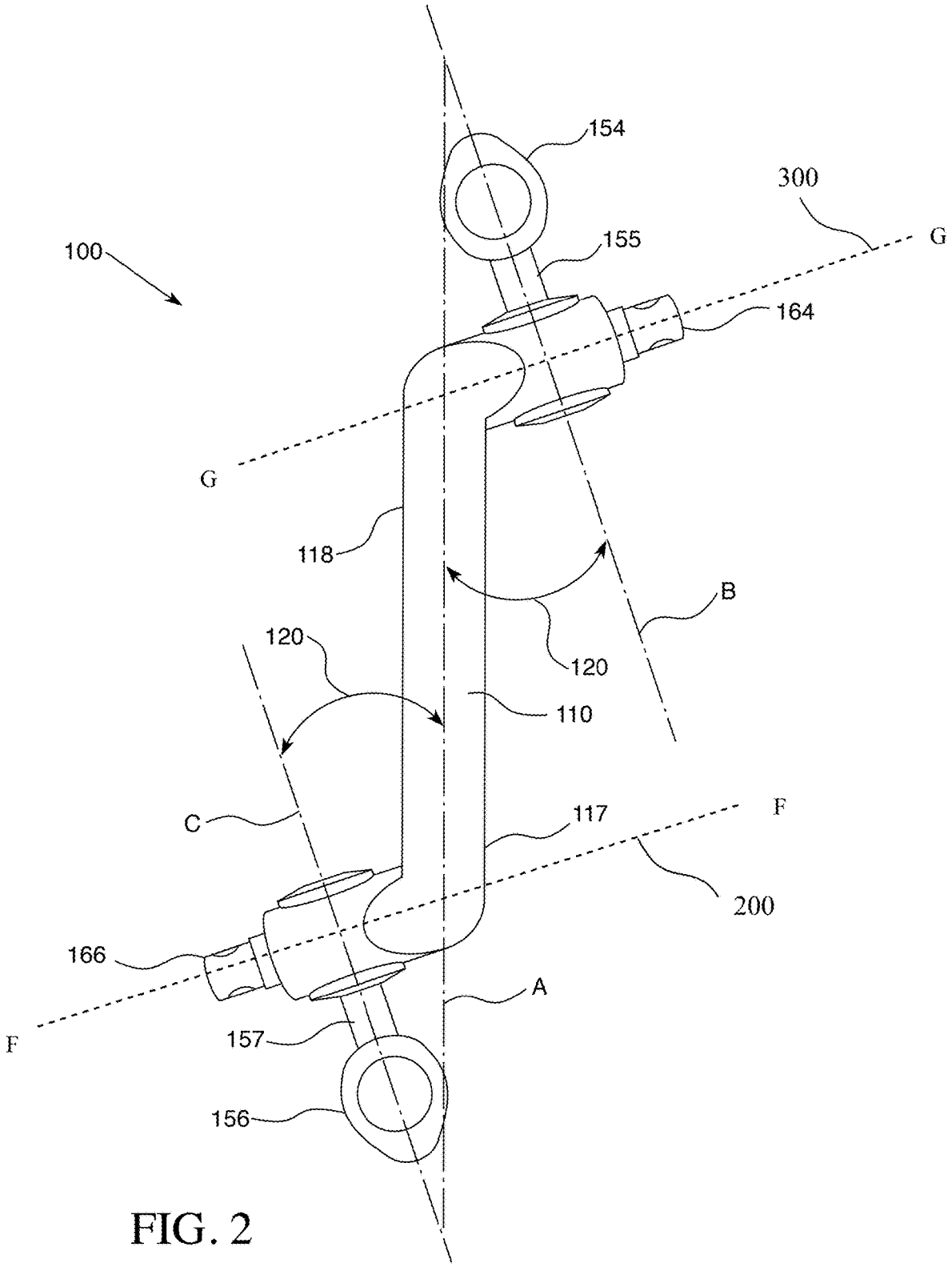
FIG. 2 is a top view of an embodiment of the exercise device.

The main structures of the exercise device can include a central framework that includes at least two handgrips wherein the handgrips are attached at opposite ends of the central framework. Referring to FIG. 1, an exercise device 100 has a frame 110. The first end 114 and the second end 116 can be offset at an oblique angle with respect to the axis A (illustrated in FIG. 2) of the frame 110. The oblique angles may range from about 100 degrees to about 120 degrees. In some embodiments, the oblique angle can be 110 degrees. The oblique angles can be configured to provide an end-user with a grip position that may provide for a neutral wrist position when an end-user grips a first handgrip 154 and a second handgrip 156. Referring to FIG. 2, Axis A may also be considered an initial side of the oblique angles where the terminal sides are axes B and C, respectively. Axis B is the axis of the first axle 155 of the first handgrip 154, and axis C is the axis of the second axle 157 of the second handgrip 157. The length of axis A may range from about 12 inches to about 17 inches. In the illustrated embodiment of FIG. 2, the length of axis B and axis C are fixed; however, in other embodiments, this length may be adjustable to accommodate the needs of an end user's physical therapy treatments.

Figure 3:
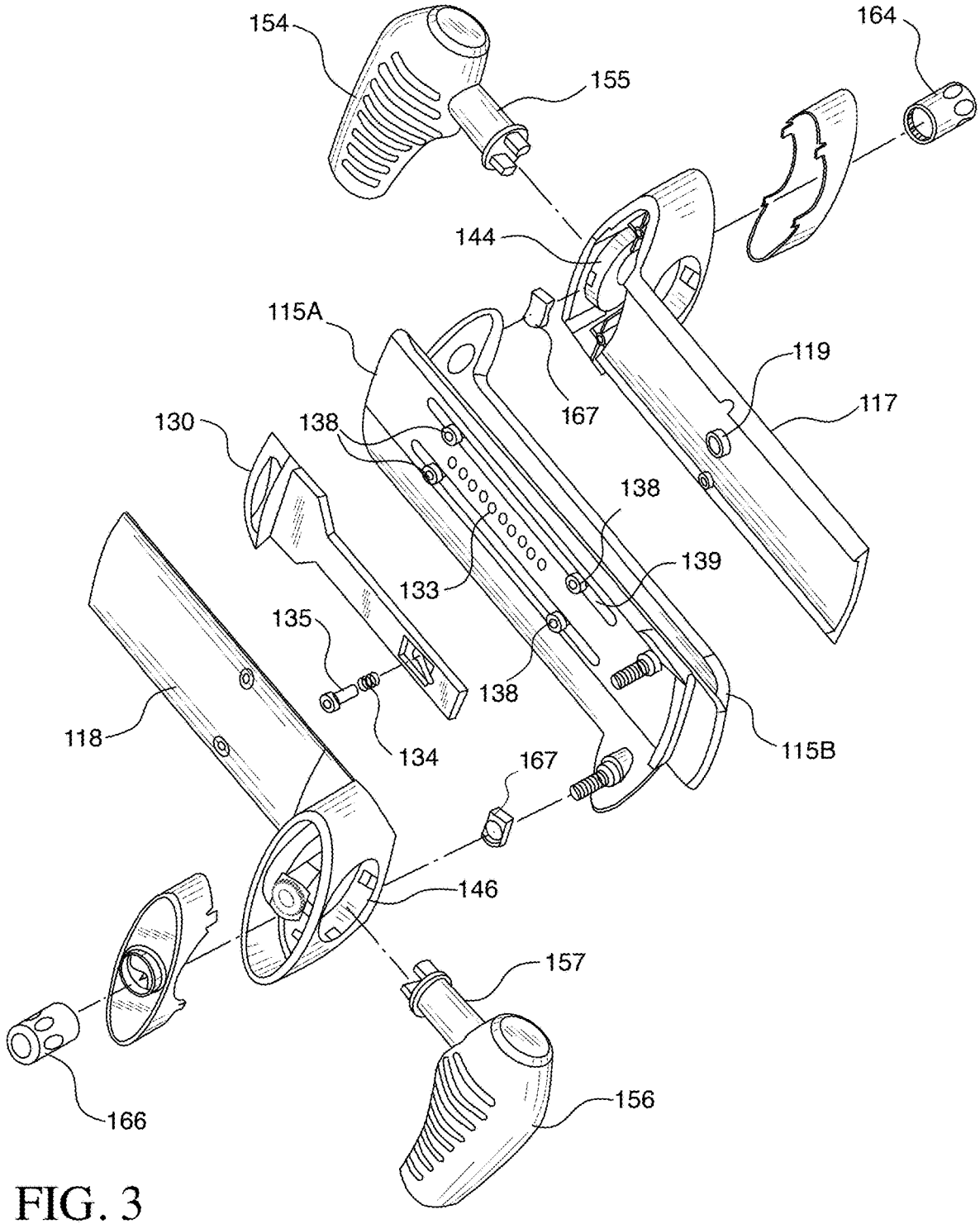
FIG. 3 is an exploded front isometric view of an embodiment of the exercise device.

The first handgrip 154 and the second handgrip 156 can be structured and configured to accommodate the palm and fingers of a user. The shapes of first handgrip 154 and second handgrip 156 may provide multiple positions for a user to grip in a manner that allows for a neutral wrist position. The grip positioning may be dictated by the muscles with which the user is attempting to exercise. The first handgrip 154 and the second handgrip 156 may also include a means to vary the tension the user may experience when rotating the handgrips. For instance, in FIG. 2, a first handgrip tensioner 164 may supply the first handgrip 154 with a variety of tensions in the same way as the second handgrip tensioner 166 may supply the second handgrip 156 with a variety of tensions. In some embodiments, this can be achieved with pressures being applied by the tightening or loosening of either first handgrip tensioner 164 or second handgrip tensioner 166. As illustrated in FIG. 3, the tensioners can force friction pads 167 against either the first bearing 144 or the second bearing 146.

In FIG. 1, a length adjuster 130 can be located just prior to the oblique angle of the second end 116. Other embodiments may not be limited to this orientation and could have the opposite arrangement where the length adjuster 130 can be located near the first end 114. The inner workings of the length adjuster 130 will be discussed infra. The main purpose of the length adjuster 130 can be to engage the inner workings, thereby allowing the exercise device 100 to increase or decrease in the length of Axis A. Such length changes can occur with the movement of the front frame section 117 and rear frame section 118 moving in opposite directions along the A axis of the adjustable frame 110.

The relationship of Axes A, B, and C are illustrated in FIG. 2. Axis A is aligned with the length of the length adjustable frame 110, where the length adjustable frame 110 may act as an initial side of oblique angles 120. Further, axes B and C may form the terminal sides of oblique angles 120. Additionally, axes B and C can be perpendicular to axes G and F respectively, where axes G and F are parallel, and axis G can be centrally disposed through the first handgrip tensioner 164 and axis F can be centrally disposed through the second handgrip tensioner 166. This arrangement may provide a user with the ability of having a neutral wrist position by griping the first handgrip 154 and the second handgrip 156, where their respective axles 155/157 are coaxial to axes B and C. The first handgrip 154 and the second handgrip 156 can be structured and configured such that a user's hands, when gripping the first handgrip 154 and the second handgrip 156, can have axes running centrally through the user's grip that can be perpendicular to their fingers; such axes can also be perpendicular to axes B and C and can be coaxial to a first handgrip axis D and a second handgrip axis E (in FIGS. 1 and 6-8) described further supra. When the length adjuster 130 is retracted by a user, the front frame section 117 and rear frame section 118 can slide in opposite directions.

Referring to FIG. 3, this exploded view of an embodiment of an exercise device 100 illustrates its construction where front frame 117 and rear frame 118 align on opposite sides of the central frame members 115A and 115B, respectively. Within the central frame member 115A may be a set of iteratively spaced cavities 133, which can work in conjunction with the peg 135 disposed within the length adjuster 130 mechanism. A second central frame member 115B, is positioned symmetrically opposite the central frame member 115A. Disposed within the face of the central frame member 115B that opposes central frame member 115A may be a series of pins 138 that may act as glides for both or either the central frame member 115A and the length adjuster 130 mechanism. In the current embodiment, pins 138 can be shoulder screws providing a smooth surface and a space to retain length adjuster 130 mechanism against the central frame member 115A. The pins 138 may be disposed through grooves 139 that may be disposed within central frame member 115A. The pins 138 and grooves 139 may provide stability to the exercise device 100 when it is being lengthened or shortened.

The rotation of the exercise device 100 may be achieved with the connection of the first handgrip 154 and its first axle 155 to a first bearing 144, and the connection of the second handgrip 156 and its second axle 157 to a second bearing 146. The first bearing 144 and the second bearing 146 may be permanently lubricated stainless steel ball bearings. However, other means of rotation may be used as known by users proficient in the art.

Figure 4:
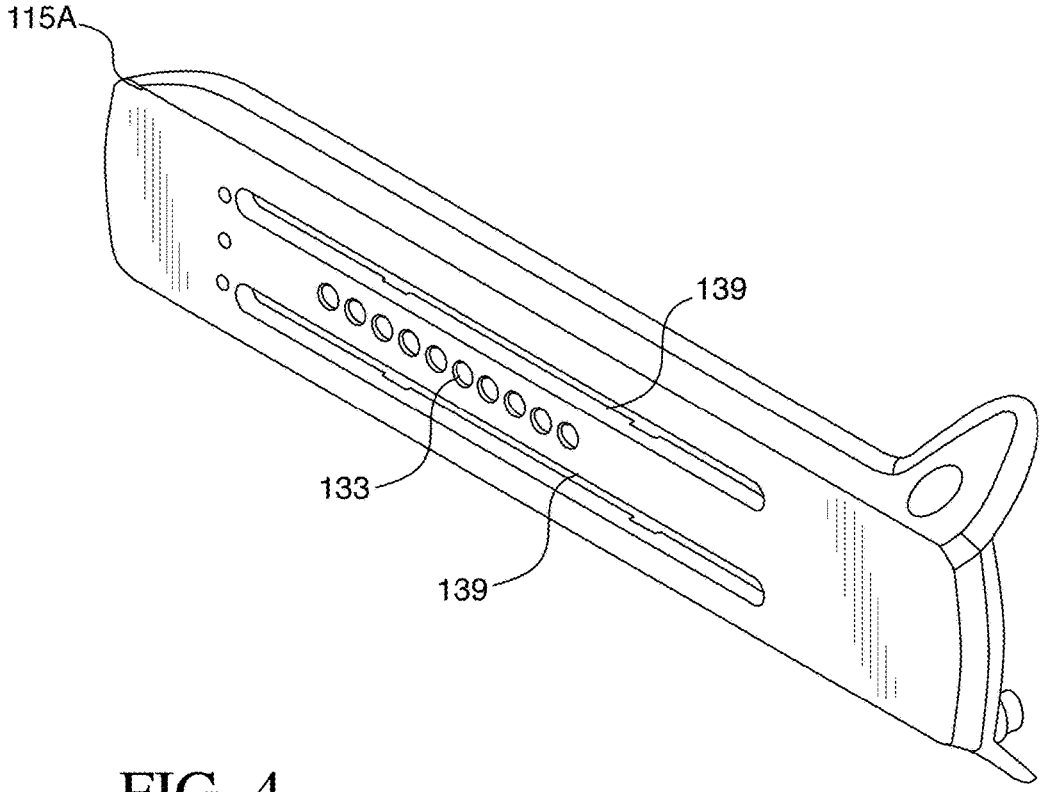
FIG. 4 is a front view of an inner beam of an embodiment of the exercise device.
Figure 5:
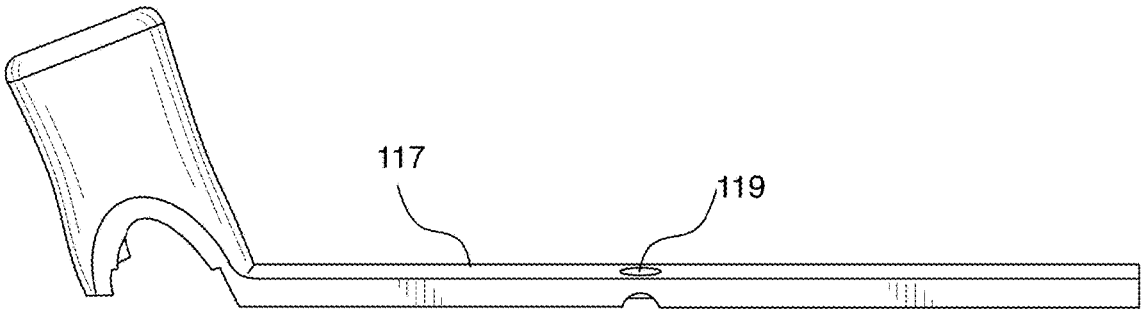
FIG. 5 is a side view of an inner beam of an embodiment of the exercise device.

The length adjuster 130 may include a finger well that can provide purchase to a user for adjusting the length of the exercise device 100. Disposed within the length adjuster 130 may be a peg 135, which may include a spring 134 disposed therebetween. The peg 135 may have a first end which can pass through one cavity of the set of iteratively spaced cavities 133 and reside within the receiver 119. In some embodiments, compression of the spring 134 may force the first end of the peg 135 out of the cavity of the set of iteratively spaced cavities 133 and receiver 119, thereby allowing the length of the exercise device 100 to be adjusted. Persons of ordinary skill may be able to provide alternatives to the length adjusting mechanisms described herein. Referring to FIG. 4, this illustration of the central frame member 115A includes the iteratively spaced cavities 133 and the grooves 139. FIG. 5 further illustrates a front frame 117, which in this embodiment includes receiver 119 that can provide an area for the peg 135 to reside when the length adjuster 130 is not being engaged by a user. The receiver 119 being combined with the first end of the peg 135 may provide further stability to the exercise device 100 for any of the desired therapeutic lengths.

Figure 6:
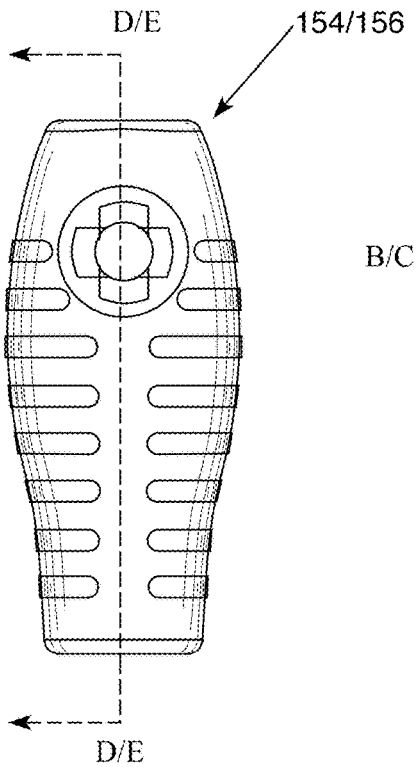
FIG. 6 is a side view of a handgrip of an embodiment of the exercise device.
Figure 7:
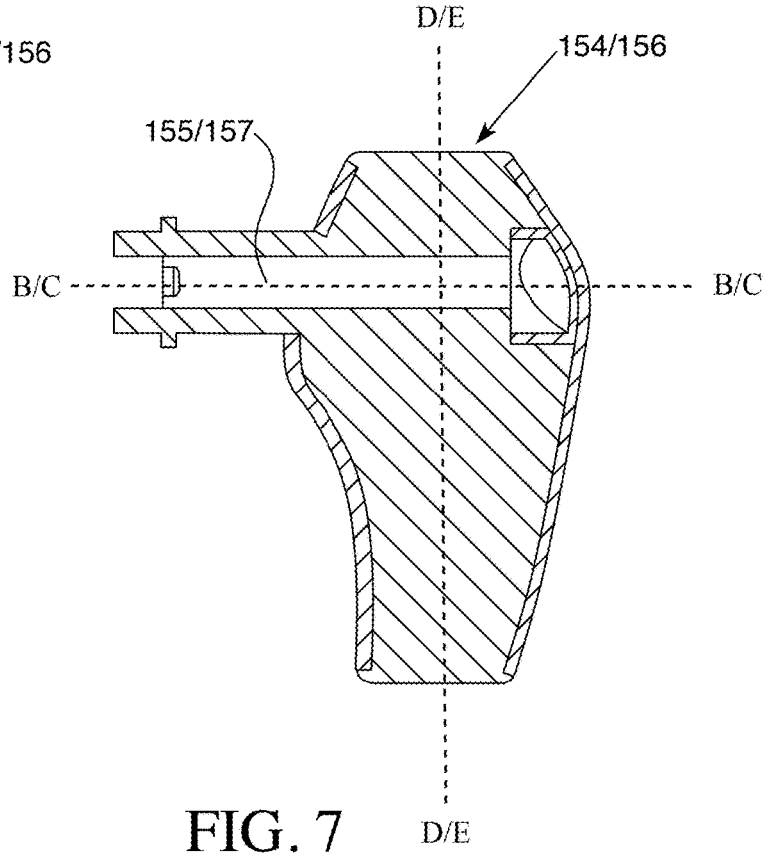
FIG. 7 is a cross-sectional view of the embodiment in FIG. 6.
Figure 8:
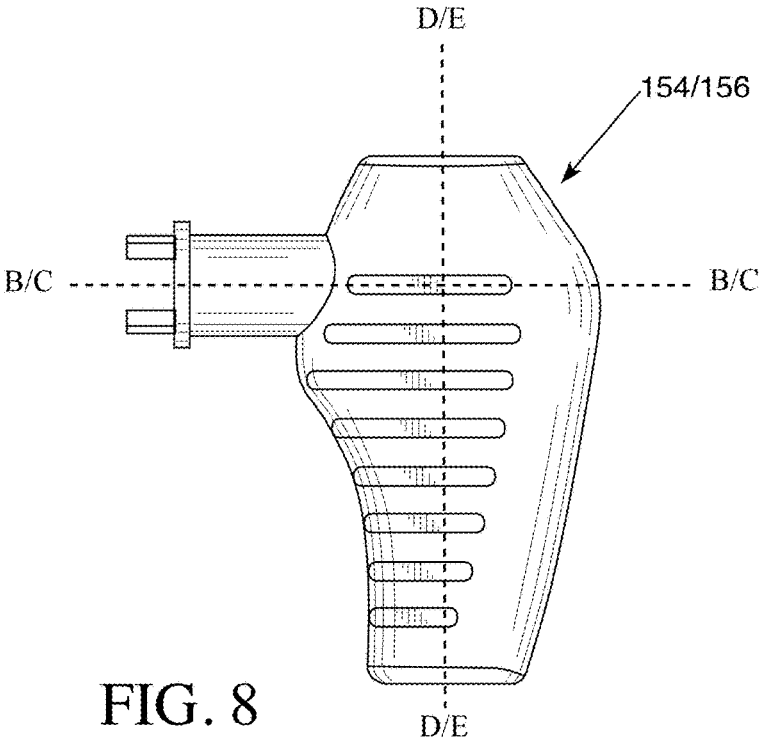
FIG. 8 is a front view of a handle of an embodiment of the exercise device.

FIGS. 6-8 provide illustrations of an embodiment of handgrips 154 and 156 which include integrated axles 155 and 157. This embodiment of handgrips 154 and 156 can provide an ergonomic grip for a user. Additional embodiments may further include a variety of surface coverings which may improve the retention of a grip by the user. These grips can be configured to ensure a user will have a neutral wrist position when handling the exercise device 100. For example, a first handgrip axis D and a second handgrip axis E can be structured and configured to be perpendicular to Axes A, B, and C (see FIGS. 2, 7, and 8) and where the first handgrip axis D runs vertically through handgrip 154 and the second handgrip axis E runs vertically through handgrip 156. The handgrips 154 and 156 can be configured such that a user's hands, by gripping handgrips 154 and 156, can essentially place the first handgrip axis D and the second handgrip axis E, centrally in a user's right and left hands, where the first handgrip axis D and the second handgrip axis E can run perpendicular to a user's fingers, thereby placing their wrists in a neutral wrist position. When using exercise device 100, the first handgrip axis D and the second handgrip axis E can circumscribe a pair of planes 200 and 300 that are parallel to each other and parallel to axes G and F (see FIG. 2), where the circumscribed planes of axes D and E can never intersect. Plane 200 can be defined as being parallel to axis F while being perpendicular to axis C, and plane 300 can be defined as being parallel to axis G while being perpendicular to axis B; as illustrated in FIG. 2. It has been contemplated that a user may only be able to use a single hand while using the exercise device 100 due to injury or loss of an opposing hand or arm. In such instances, an attachment may be provided as a substitute for the user's missing appendage; such an attachment may be able to hold the exercise device 100 stably through a further connection to a fixed surface.

Other possible use for such an exercise device may include use as a component in a dual-task coordination exercise, combining the rotational component with cognitive or memory training or eye-tracking training. The exercise device may include use as a component in hemiparesis recovery for contralateral retraining or constraint retraining. The exercise device may include use as a component in balance exercises in conjunction with variable surface densities and support along, or with a gradually narrowed static base of support from two feet and progressing to one foot, or via a combination of these and other balance progressions. The exercise device may include use as a component for postural retraining while seated, kneeling, tall-kneeling, half-kneeling, standing, or while sitting on devices of variable density and support for postural, midline, and seated balance training. The exercise device may include use as a component in abdominal and core control exercises while in a partial crunch formation in order to further stress the musculature.

Persons of ordinary skill in arts relevant to this disclosure and subject matter hereof will recognize those embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is also intended to include features of a claim in any other independent claim, even if this claim is not directly made dependent on the independent claim.

What is claimed:

1. An arm exercise device comprising:

a length adjustable frame having a frame axis, a first end, and a second end, wherein the first end and the second end are positioned at opposite oblique angles with respect to the frame axis;

a length adjuster;

a first bearing disposed within the first end;

a second bearing disposed within the second end;

a first tensioner, wherein the first tensioner is disposed on the first end and is structured and configured to adjust a torque of the first bearing;

a second tensioner, wherein the second tensioner is disposed on the second end and is structured and configured to adjust a torque of the second bearing;

a first ergonomic handgrip disposed on the first bearing, wherein the first ergonomic handgrip has a first handgrip axis that is perpendicular to a first tensioner axis;

a second ergonomic handgrip disposed on the second bearing, wherein the second ergonomic handgrip has a second handgrip axis that is perpendicular to a second tensioner axis;

wherein the first handgrip axis and the second handgrip axis are structured and configured to circumscribe a pair of respective planes that are parallel and do not intersect.

2. The arm exercise device of claim 1, further comprising a set of iteratively spaced cavities disposed within the length adjustable frame.

3. The arm exercise device of claim 2, further comprising a peg disposed within the length adjustable frame, wherein the peg is structured and configured to fit within the set of iteratively spaced cavities, and wherein the length adjuster will disengage and engage the peg from the set of iteratively spaced cavities.

4. The arm exercise device of claim 3, wherein the length adjuster is structured and configured to provide an adjustable length of the axis in a range of twelve to seventeen inches.

5. The arm exercise device of claim 1, wherein the first ergonomic handgrip further comprises a first axle having a first axle axis, wherein the first axle is disposed on the first bearing; and the second ergonomic handgrip further comprises a second axle having a second axle axis, wherein the second axle is disposed on the second bearing.

6. The arm exercise device of claim 5, wherein the first axle axis and the second axle axis are terminal sides of the opposite oblique angles wherein the frame axis is the initial side.

7. The arm exercise device of claim 5, wherein the first axle axis is perpendicular to the first handgrip axis, and the second axle axis is perpendicular to the second handgrip axis.

8. The arm exercise device of claim 1, wherein the first tensioner further comprises a tension pad, and the second tensioner comprises a tension pad.

9. The arm exercise device of claim 1, wherein the opposite oblique angles are about 100 degrees to about 120 degrees with respect to the frame axis.

10. The arm exercise device of claim 1, wherein the first ergonomic handgrip and the second ergonomic handgrip are structured and configured to provide a user with multiple gripping positions.

11. A method of use of an arm exercise device comprising the following steps:

providing an arm exercise device comprising:

a length adjustable frame having a frame axis, a first end, and a second end, wherein the first end and the second end are positioned at opposite oblique angles with respect to the frame axis;

a length adjuster;

a first bearing disposed within the first end;

a second bearing disposed within the second end;

a first ergonomic handgrip disposed on the first bearing;

a first tensioner, wherein the first tensioner is disposed on the first end and is structured and configured to adjust the torque of the first bearing;

a second ergonomic handgrip disposed on the second bearing; and a second tensioner, wherein the second tensioner is disposed on the second end and is structured and configured to adjust the torque of the second bearing;

determining a first grip position for an end-user to grip the first ergonomic handgrip with a first hand, wherein the first ergonomic handgrip has a first handgrip axis that is perpendicular to a first tensioner axis, wherein the first handgrip axis is structured and configured to ensure a neutral wrist position for the first hand of the end-user;

determining a second grip position for the end-user to grip the second ergonomic handgrip with a second hand, wherein the second ergonomic handgrip has a second handgrip axis that is perpendicular to a second tensioner axis, wherein the second handgrip axis is structured and configured to ensure a neutral wrist position for the second hand of the end-user, and wherein the first handgrip axis and the second handgrip axis are structured and configured to circumscribe a pair of respective planes that are parallel and do not intersect;

setting a first tension for the first tensioner;

setting a second tension for the second tensioner;

instructing the end-user to place their first hand in the first grip position;

instructing the end-user to place their second hand in the second grip position; and instructing the end-user to rotate the arm exercise device.

12. The method of using an arm exercise device of claim 11, wherein the first ergonomic handgrip further comprises a first axle having a first axle axis, wherein the first axle is disposed on the first bearing; and the second ergonomic handgrip further comprises a second axle having a second axle axis, wherein the second axle is disposed on the second bearing.

13. The method of using an arm exercise device of claim 12, wherein the first axle axis and the second axle axis are terminal sides of the opposite oblique angles wherein the frame axis is the initial side.

14. The method of using an arm exercise device of claim 13, wherein the opposite oblique angles are about 100 degrees to about 120 degrees.

15. The method of using an arm exercise device of claim 13, wherein the first axle axis is perpendicular to the first handgrip axis, and the second axle axis is perpendicular to the second handgrip axis.

16. The method of using an arm exercise device of claim 11, wherein the first ergonomic handgrip and the second ergonomic handgrip are structured and configured to provide the end-user with multiple gripping positions.

17. The method of using an arm exercise device of claim 11, wherein the length adjuster is structured and configured to provide an adjustable length of the axis in a range of twelve to seventeen inches.

18. The method of using an arm exercise device of claim 17, comprising the further steps of determining a therapeutic length for the end-user, and setting the adjustable length of the frame axis to the therapeutic length.

* * * * *